United States Patent [19]

Gandy et al.

[11] Patent Number: 4,937,961

[45] Date of Patent: Jul. 3, 1990

[54] SIGN ASSEMBLY

[75] Inventors: James Gandy; Bruce E. S. MacDonald, both of Mississauga, Canada

[73] Assignee: Signtech, Inc., Ontario, Canada

[21] Appl. No.: 321,044

[22] Filed: Mar. 9, 1989

[51] Int. Cl.[5] ..... G09F 17/00

[52] U.S. Cl. ..... 40/603; 40/574; 160/378; 38/102.91

[58] Field of Search ..... 40/603, 604, 574; 38/102.1, 102.3, 102.2, 102.91; 24/460, 461, 462, 546, 555, 556, 563; 160/378, 399, 402

[56] References Cited

U.S. PATENT DOCUMENTS

| | | | |
|---|---|---|---|
| 3,329,195 | 7/1967 | Kochanowski | 160/399 |
| 3,529,653 | 9/1970 | Fey, Jr. | 160/378 X |
| 3,803,671 | 4/1974 | Stuppy et al. | 24/460 |
| 4,452,000 | 6/1984 | Gandy | 40/574 |
| 4,554,754 | 11/1985 | Stilling | 40/603 |

*Primary Examiner*—Kenneth J. Dorner
*Assistant Examiner*—Joanne Bonifanti
*Attorney, Agent, or Firm*—Davis, Bujold & Streck

[57] ABSTRACT

A sign assembly has a frame surrounding an aperture, and a sheet of flexible sign material has a main portion stretched across the aperture and an end portion secured to the frame. The frame has a lip member defining the aperture, the lip member having a free end over which the flexible sign sheet passes, the frame also having a U-shaped channel portion rearwardly of the lip member and receiving an end portion of the sign sheet. A mounting bar extends longitudinally within the U-shaped channel, and the sheet end portion is wrapped, around the mounting bar. A series of spaced U-shaped resilient clips retain the mounting bar and wrapped around sheet end portion therein. The U-shaped channel has at least one wall with a plurality of longitudinally-extending shoulders which face in a rearward direction from the lip member. Each clip is snappingly engageable with successive shoulders in the channel to enable the flexible sign sheet to be tensioned by pushing the clips with the mounting bar and wrapped around sheet end portion retained therein rearwardly in the channel to cause the clip to snappingly engage successive shoulders until the sheet is suitably tensioned.

5 Claims, 5 Drawing Sheets

Figure 1:
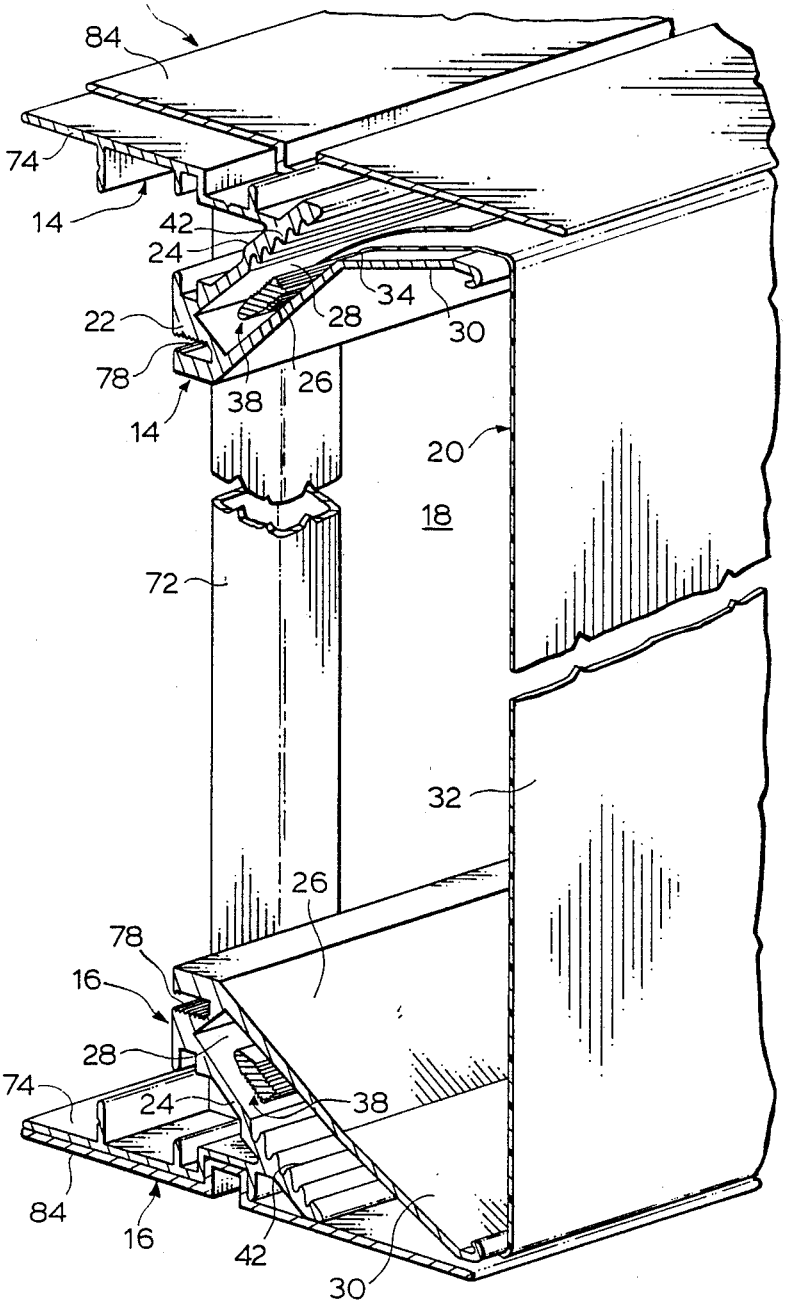

FIG.3.
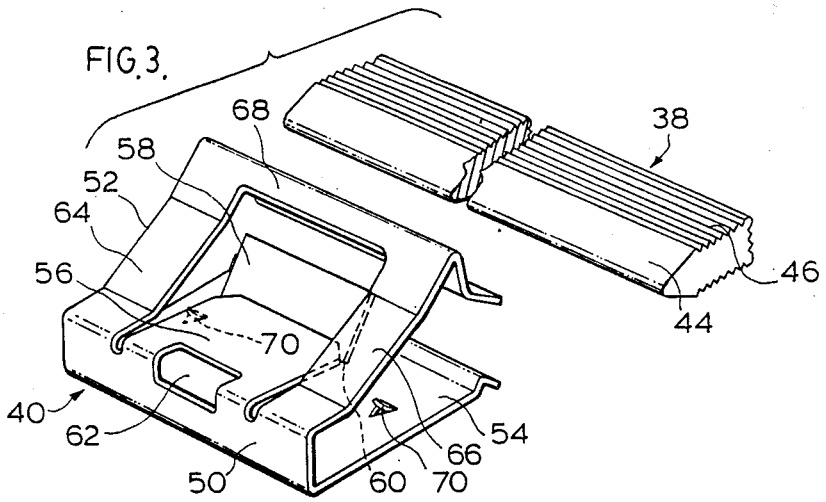
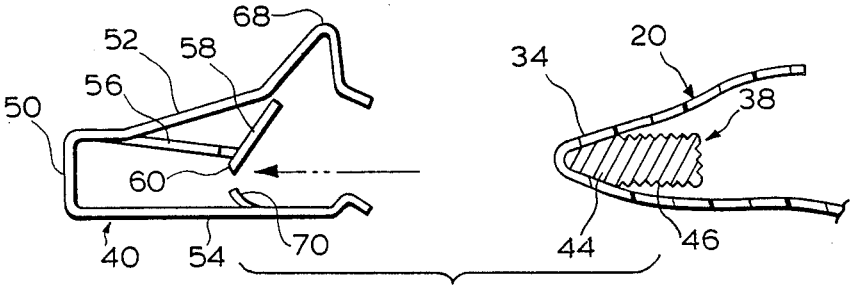
FIG.4.
FIG.5.
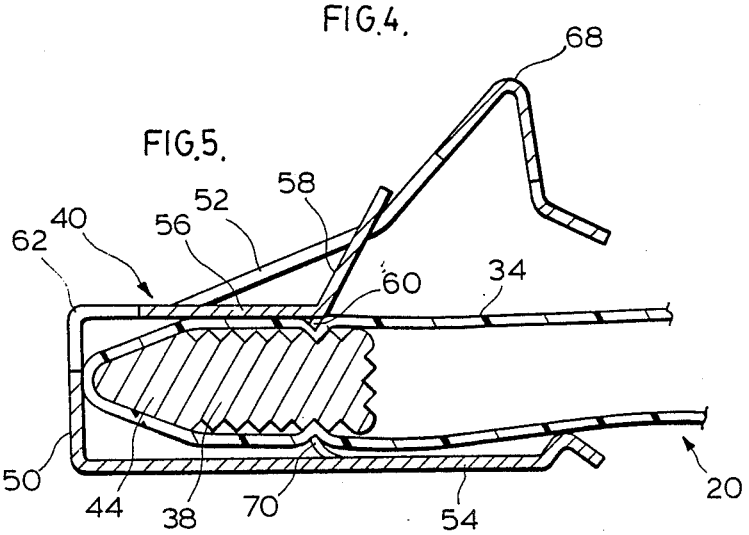

SIGN ASSEMBLY

This invention relates to sign assemblies which have a sign-bearing sheet of flexible material stretch across a frame.

A sign assembly of this kind is described in U.S. Pat. No. 4,542,605 (Gandy) issued 24 Sept. 1985, the contents of which are hereby incorporated herein by reference. In this prior patent, the flexible sign sheet is tensioned across the frame by a series of separate tensioning devices spaced around the frame, each tensioning device comprising a screw which can be adjusted to increase the tension of the sign sheet across the frame. Although this arrangement provides an effective tensioning procedure, there is currently a need for a simplified procedure.

It is therefore an object of invention to provide a sign assembly of the kind referred to which enables the flexible sign sheet to be tensioned in an easier manner than is the case with known sign assemblies of this kind.

According to the present invention, the frame has a lip member defining the frame aperture and having a free end over which a flexible sign sheet passes, the frame also having a U-shaped channel portion rearwardly of the lip member and receiving an end portion of the sign sheet. Each sheet-holding assembly comprises a mounting bar extending longitudinally within U-shaped channel and around which the sheet end portion is wrapped, and a series of U-shaped resilient clips within which the mounting bar and wrapped around sheet end portion are received, said clips having means for retaining the mounting bar and wrapped around sheet end portion therein.

The U-shaped channel has at least one wall with the plurality of longitudinally extending shoulders which face in the rearward direction from the lip member. Each clip has engaging means snappingly engageable with successive shoulders in the channel to enable the flexible sign sheet to be tensioned by pushing the clips with the mounting bar and wrapped around sheet end portion retained therein rearwardly in the channel to cause the shoulder engaging means of the clips to snappingly engage successive shoulders until the sheet is suitably tensioned.

Thus, after assembling the end portion of the sign sheet with the mounting bar and the clips, the resulting assembly is pushed into the channel in the frame, with the shoulder engaging means of each clip snapping into engagement with the successive shoulders until a suitable sign sheet tension is achieved.

Each clip may comprise two opposed sides, one of which has an inwardly inclined portion providing said means for retaining a mounting bar and wrapped around sheet end portion within the clip, and an outwardly inclined portion providing said engagement means snappingly engageable with successive shoulders.

The sheet retaining means may be formed by a central inwardly inclined portion of said one side, with the shoulder engaging means being formed by an outwardly inclined portion of said one side which extends around the sheet retaining means.

The lip member may project beyond the U-shaped channel at an acute angle to the main portion of the sign sheet to position the channel within the periphery of and behind the main portion of the sign sheet, and thereby cause the frame to be hidden behind the main portion of the sign sheet when the sign assembly is viewed from the front.

The frame may comprise opposed frame members, at least one of which is provided with said lip member and said channel, and said mounting bar and a series of said clips in said channel, the sign assembly also including at least one elongated bracing member with opposed end portions secured to respective frame members.

One embodiment of the invention will now be described, by way of example, with reference to the accompanying drawings, of which; FIG. 1 is a perspective end view, partly in section, of a sign assembly showing upper and lower frame members, the flexible sign sheet and a bracing member, FIG. 2 is a transverse sectional view of the upper part of the sign assembly showing the upper frame member, flexible sign sheet and bracing member, FIG. 3 is an exploded perspective view of a clip and the mounting bar, with the sign sheet being omitted for clarity.

Figure 7:
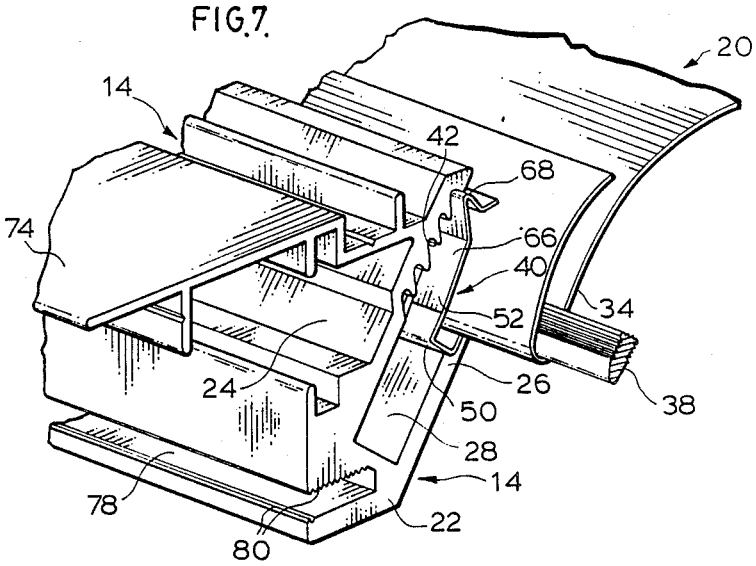
Figure 6:
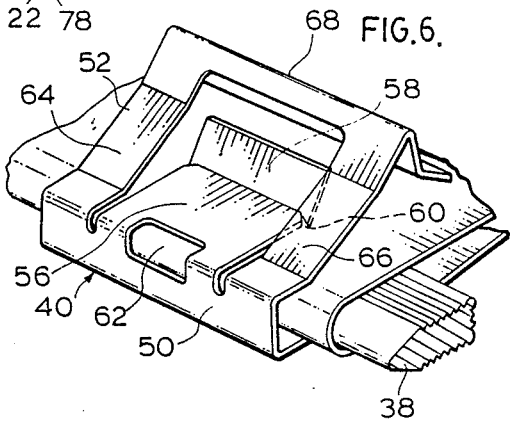

FIG. 4 is an exploded sectional side view thereof also showing the sign sheet, FIG. 5 is a sectional side view of a clip fully assembled with the sign sheet and mounting bar, FIG. 6 is a perspective view thereof, and FIG. 7 is a perspective view showing the clip with contained sign sheet and mounting bar being inserted into the channel in the upper frame member. Referring to the drawings, a sign assembly has a rectangular frame 12 whose upper and lower frame members 14, 16 are shown in FIG. 1. It will be understood that the frame 12 will also have left and right hand side frame members (not shown). The various frame members are secured together at their ends by corner pieces (also not shown) to form a rectangular frame in a manner which will be readily apparent to a person skilled in the art. Each frame member is an aluminum extrusion. The frame members define an aperture 18 across which a sheet 20 of flexible sign material is stretched. Further description will be primarily in connection with upper frame 14, but it will be understood that such description also applies to the lower frame member 16 and the side frame members.

Figure 2:
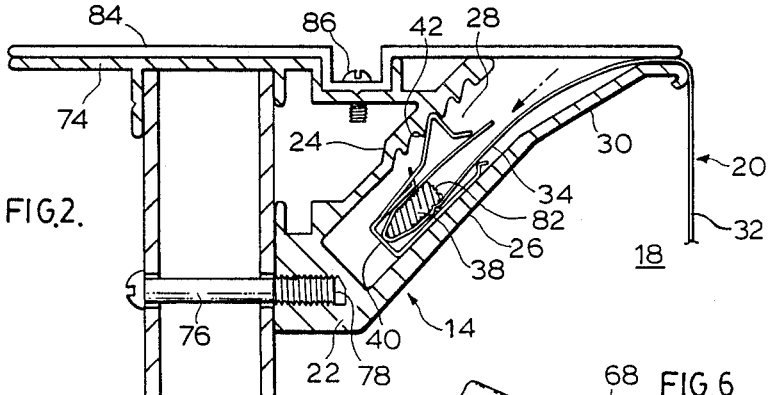

As shown particularly in FIG. 2, the upper frame member 14 has a base 22 from which upper and lower spaced walls 24, 26 extend at an angle of 45° to the vertical. The walls 24, 26 and base portion 22 form a U-shaped channel portion defining a channel 28. The lower wall 26 extends beyond the upper wall 24 to form a lip member 30 which defines the edges of the aperture 18.

The sign sheet 20 has a main portion 32 extending across the aperture 18 and an end portion 34 which passes around the free end of the lip member 30 and into the channel 28. The sheet end portion 34 is retained in the channel 28 by a mounting bar 38 and a series of clips 40. The sheet end portion 34 is wrapped around the mounting bar 38 and held therein by the slips 40 which are spaced along the mounting bar 38. Each clip 40 is in turn retained within the channel 28 by engagement with one of a series of rearwardly facing shoulders 42 formed on the inner surface of the upper wall 28. The mounting bar 38 has a generally rectangular section, except that the rear end portion 44 is tapered. Forwardly of the tapered rear end portion 44, the upper and lower surfaces of the mounting bar 38 have closely spaced longitudinally extending ridges 46. The mounting bar 38 is also an aluminum extrusion.

Each clip 40 is of resilient sheet metal and is formed by stamping and bending The clip 40 is U-shaped with a base 50 and opposite sides 52, 54 The medial portion of the side 52 is stamped out to form a tongue 56 which initially is inclined inwardly from the base 50 towards the opposite side 54. The free end portion 58 is bent to extend in an outwardly inclined direction and is provided with a pair of inwardly and rearwardly extending prongs 60 at the line of bending. A portion of the tongue 56 and base 50 is removed to leave an aperture 62, thereby permitting the tongue 56 to flex more easily relative to the base 50.

The remaining portion of the side 52 extends around the tongue 56 and comprises arms 64, 66 which extend from the base 50 and a free end portion 68 extending transversely between the outer ends of the arms 64, 66. After initially extending parallel to the opposite side 54, the arms 64, 66 extend in an outwardly inclined direction to the free end portion 68 which is shaped to provide an outwardly projecting shoulder. The opposite side 54 of the clip 40 has a pair of prongs 70 stamped out therefrom, the prongs 70 being directed inwardly and rearwardly.

The upper and lower frame members 14, 16 are prevented from being bowed inwardly under the tension of the sign sheet 20 by transversely spaced bracing bars 72. Each bracing bar 72 is a tubular member whose upper end engages the underside of a part 74 of the frame member 14 which extends rearwardly from the upper wall 24 of the channel 28. Similarly, the lower end of bracing bar 72 engages the upper surface of a similar part 76 of the frame member 16. Each bracing bar 72 is secured to the base 22 of the frame member 14 by a bolt 76 which passes through bracing bar 72 into a longitudinally extending groove 78 in the base 22 of the frame member 14. The groove 78 has longitudinally extending ridges 80 in opposed walls to engage the threads of the screws 76. The bracing bar 72 is also secured to the lower frame member 16 in a similar manner (not shown).

When assembling the sign sheet 20 with the frame 12, the sheet end portion 34 is wrapped around the mounting bar 38 of each sheet holding assembly 36 in turn. The clips 40 are then pushed onto the mounting bar 38 at longitudinally spaced intervals, see FIGS. 4 to 6, until the tapered end 44 of the mounting bar 38 engages the base 50 of each clip 40 (with the sign sheet end portion 34 therebetween). The prongs 60 on the tongue 76 and the prong 70 on the lower side 54 of each clip snap over the rear end 44 of the mounting bar 38 and engage in the ridges 46 at the top and bottom respectively, thereby retaining the clips 40 and also the sign sheet portion 34 in engagement with the mounting bar 38.

The mounting bar 38 with assembled sign end portion 34 and clips 40 is then inserted into a channel 28 of the frame member 14 or 16 as the case may be, see FIG. 7, until the sign sheet 20 is suitably tensioned. During such insertion, the outward projection 68 on the upper wall of each clip 40 snaps past each shoulder 42 in the channel 28 in turn more so that each clip 40 is retained in position by the shoulder 42 then engaged by the clip 40.

In practice, the mounting bars 38 will be inserted an initial distance into the channels 28 in the upper and lower frame members 14, 16 until the sign sheet 20 is almost taut. The mounting bars 38 are then pushed further into the channels 28 in turn until the desired tension in the sign sheet 20 is achieved. Similar comments apply of course to the side frame members.

When the sign sheet 20 has been suitably tensioned, a cover plate 84 is fitted to the exterior of each frame member. As shown in FIG. 2, the cover plate 84 is secured to frame member 14 by screws 86 spaced therealong. The cover plate 84 covers the top of the frame member 14 so as to conceal the channel 28 and sheet end portions 34. The cover plate 84 also extends rearwardly across the rearward extension 74 of the frame member 14. A cover plate 84 is similarly secured to each of the various frame members.

It will be noted that, because of the angular disposition of the lip members 30 of the frame members, the channels 28 are positioned within the periphery of and behind the main portion 32 of the sign sheet 20 so that the frame is hidden behind the sign sheet main portion 32 when the sign assembly is viewed from the front. As previously mentioned, the cover plates 84 cover the frame members from other angles of view, thereby providing the sign assembly with an attractive appearance (as is also the case in U.S. Pat. No. 4,542,605 previously referred to).

In a typical sign assembly, the length of the upper and lower frame members 14, 16 may be about 20 feet, with the length of the side members being about 4 feet. The clips 40 may be spaced apart at intervals of about 6 to 8 inches on the mounting bars 38. For convenience, two mounting bars 38 each with a length of about 10 feet may be provided for each of the upper and lower frame members. The bracing bars 72 may be spaced apart by about 4 to 5 feet.

The easy installation of a sign sheet 20 on the frame in accordance with the invention will be readily appreciated by a person skilled in the art by the foregoing description of a preferred embodiment. It will be noted that each clip 40 can be removed from the channel 28 by disengaging the outward projection 68 therefrom with a suitable tool (such as a screw driver) from shoulder 42, at the same time pulling the sheet end portion 34 out of the channel 28.

Other embodiments of the invention will also be readily apparent to a person skilled in the art, the scope of the invention being defined in the appended claims.

I claim:

1. A sign assembly comprising a frame surrounding an aperture, and a sheet of flexible sign material with a main portion stretched across the aperture and an end portion secured to the frame, the frame having a lip member defining the aperture and having a free end over which the flexible sign sheet passes, the frame also having a U-shaped channel portion rearwardly of the lip member and receiving an end portion of the sign sheet, a mounting bar extending longitudinally within the U-shaped channel and around which the sheet end portion is wrapped, and a series of spaced U-shaped resilient clips within which the mounting bar and wrapped around sheet end portion are received, said clips having means for retaining the mounting bar and wrapped around sheet end portion therein, the U-shaped channel having at least one wall with a plurality of longitudinally-extending shoulders which face in a rearward direction from the lip member, and each clip having engagement means snappingly engageable with successive shoulders in the channel to enable the flexible sign sheet to be tensioned by pushing the clips with the mounting bar and wrapped around sheet end portion retained therein rearwardly in the channel to cause the shoulder engaging means of the clip to snappingly engage successive shoulders until the sheet is suitably tensioned.

2. A sign assembly according to claim 1 wherein each clip comprises two opposed sides, one of which has an inwardly inclined portion providing said means for retaining the mounting bar and wrapped around sheet end portion within the clip, and an outwardly inclined portion providing said engagement means snappingly engageable with successive shoulders.

3. A sign assembly according to claim 2 wherein the sheet retaining means is formed by a central inwardly inclined portion of said one side, and the shoulder engaging means is formed by an outwardly inclined portion of said one side which extends around the sheet retaining means.

4. A sign assembly according to claim 1 wherein the lip member projects beyond the U-shaped channel at an acute angle to the main portion of the sign sheet to position the channel within the periphery of and behind the main portion of the sign sheet, and thereby cause the frame to be hidden behind the main portion of the sign sheet when the sign assembly is viewed from the front.

5. A sign assembly according to claim 1 wherein frame comprises opposed frame members, at least one of which is provided with said lip member and said channel, and said mounting bar and a series of said clips in said channel, the sign assembly also including at least one elongated bracing member with opposite end portions secured to respective frame members.

* * * * *